US008484793B2

(12) United States Patent
Nanda

(10) Patent No.: US 8,484,793 B2
(45) Date of Patent: Jul. 16, 2013

(54) TOOTHBRUSH AND METHOD OF USE

(75) Inventor: Puneet Nanda, Cerritos, CA (US)

(73) Assignee: Children Oral Care, LLC, Buena Park, CA (US)

( * ) Notice: Subject to any disclaimer, the term of this patent is extended or adjusted under 35 U.S.C. 154(b) by 915 days.

(21) Appl. No.: 12/267,853

(22) Filed: Nov. 10, 2008

(65) Prior Publication Data

US 2009/0144919 A1 Jun. 11, 2009

Related U.S. Application Data

(60) Provisional application No. 60/986,558, filed on Nov. 8, 2007.

(51) Int. Cl.
*A46B 15/00* (2006.01)

(52) U.S. Cl.
USPC ..... 15/105; 434/263

(58) Field of Classification Search
USPC ..... 15/105; 434/263; 200/302.1, 302.2, 200/332, 332.1, 341
See application file for complete search history.

(56) References Cited

U.S. PATENT DOCUMENTS

| | | | | |
|---|---|---|---|---|
| 3,019,572 | A | | 2/1962 | Berry et al. |
| 3,324,997 | A | | 6/1967 | Bonanno |
| 3,884,635 | A | | 5/1975 | Sloan |
| 4,154,997 | A | | 5/1979 | Grebner et al. |
| 4,214,657 | A | | 7/1980 | Winston |
| 4,476,604 | A | | 10/1984 | White et al. |
| 4,779,173 | A | | 10/1988 | Carr et al. |
| 4,788,734 | A | * | 12/1988 | Bauer ..... 15/105 |
| 4,866,807 | A | * | 9/1989 | Kreit et al. ..... 15/105 |
| 5,000,376 | A | | 3/1991 | Wojdyla |
| D317,718 | S | | 6/1991 | Carol |
| 5,030,090 | A | | 7/1991 | Maeda et al. |
| 5,044,037 | A | * | 9/1991 | Brown ..... 15/105 |
| 5,068,939 | A | | 12/1991 | Holland |
| 5,160,194 | A | | 11/1992 | Feldman |
| 5,259,086 | A | * | 11/1993 | Fong ..... 15/105 |
| 5,339,479 | A | | 8/1994 | Lyman |
| 5,382,107 | A | | 1/1995 | Nian |

(Continued)

FOREIGN PATENT DOCUMENTS

| | | |
|---|---|---|
| CN | ZL 03266969.0 | 8/2004 |
| DE | 004029770 | 3/1992 |

(Continued)

OTHER PUBLICATIONS

Written Opinion and Search Report of the International Searching Authority from PCT/US2008/060121 mailed Jun. 23, 2008.

(Continued)

*Primary Examiner* — Mark Spisich
(74) *Attorney, Agent, or Firm* — Snell & Wilmer LLP

(57) ABSTRACT

A toothbrush with a handle having a base, a body, and a head. The body having a first section and a second section forming an oblique angle. A projector of sound or music located within the handle. The toothbrush having at least one bristle attached to the head. The toothbrush having a handle cover attached to the base. A method of using a toothbrush including the step of gripping the toothbrush. The method further including the step of engaging the projector of sound or music. The method still further including the step of utilizing the toothbrush while the projector of sound or music is activated.

20 Claims, 10 Drawing Sheets

U.S. PATENT DOCUMENTS

| | | | | |
|---|---|---|---|---|
| 5,485,646 | A | 1/1996 | Merritt | |
| 5,561,881 | A | 10/1996 | Klinger et al. | |
| 5,572,762 | A | 11/1996 | Scheiner | |
| 5,625,916 | A | 5/1997 | McDougall | |
| 5,784,743 | A | 7/1998 | Shek | |
| 5,801,637 | A | 9/1998 | Lomholt | |
| 5,960,507 | A * | 10/1999 | Dutra et al. | 15/105 |
| 6,026,828 | A | 2/2000 | Altshuler | |
| 6,029,304 | A | 2/2000 | Hulke et al. | |
| 6,106,294 | A | 8/2000 | Daniel | |
| 6,154,912 | A | 12/2000 | Li | |
| 6,178,579 | B1 | 1/2001 | Blaustein et al. | |
| 6,189,693 | B1 | 2/2001 | Blaustein et al. | |
| 6,202,242 | B1 | 3/2001 | Salmon et al. | |
| 6,202,245 | B1 * | 3/2001 | Khodadadi | 15/105 |
| 6,360,395 | B2 | 3/2002 | Blaustein et al. | |
| 6,389,633 | B1 | 5/2002 | Rosen | |
| D458,454 | S | 6/2002 | Nanda | |
| D458,758 | S | 6/2002 | Nanda | |
| 6,437,267 | B1 * | 8/2002 | Imai | 200/302.1 |
| 6,536,068 | B1 | 3/2003 | Yang et al. | |
| 6,606,755 | B1 | 8/2003 | Robinson et al. | |
| 6,611,780 | B2 | 8/2003 | Lundell et al. | |
| 6,623,272 | B2 | 9/2003 | Clemans | |
| 6,725,490 | B2 | 4/2004 | Blaustein et al. | |
| D490,247 | S | 5/2004 | Nanda | |
| 6,735,802 | B1 | 5/2004 | Lundell et al. | |
| D492,116 | S | 6/2004 | Nanda | |
| D505,015 | S | 5/2005 | Nanda | |
| D508,399 | S | 8/2005 | Nanda | |
| 6,954,961 | B2 | 10/2005 | Ferber et al. | |
| 7,013,522 | B2 | 3/2006 | Kumagai | |
| 7,109,431 | B2 * | 9/2006 | Yanai et al. | 200/512 |
| 7,201,172 | B2 | 4/2007 | Nanda | |
| 7,596,827 | B1 | 10/2009 | Puneet | |
| 7,718,906 | B2 | 5/2010 | Au et al. | |
| 8,011,054 | B2 | 9/2011 | Nanda | |
| 2003/0140437 | A1 | 7/2003 | Eliav et al. | |
| 2003/0205492 | A1 * | 11/2003 | Ferber et al. | 206/362.2 |
| 2004/0057233 | A1 | 3/2004 | Sharrah et al. | |
| 2004/0143920 | A1 | 7/2004 | Nanda | |
| 2004/0168272 | A1 | 9/2004 | Prineppi | |
| 2005/0150067 | A1 | 7/2005 | Cobabe et al. | |
| 2006/0037158 | A1 * | 2/2006 | Foley et al. | 15/105 |
| 2006/0174431 | A1 | 8/2006 | Nanda | |
| 2007/0039109 | A1 | 2/2007 | Nanda | |
| 2007/0074359 | A1 * | 4/2007 | O'Lynn | 15/105 |
| 2007/0131241 | A1 | 6/2007 | Nanda | |
| 2007/0261185 | A1 * | 11/2007 | Guney et al. | 15/22.1 |
| 2007/0271760 | A1 | 11/2007 | Nanda | |
| 2008/0028553 | A1 * | 2/2008 | Batthauer | 15/105 |
| 2008/0250591 | A1 | 10/2008 | Nanda | |
| 2008/0256730 | A1 * | 10/2008 | Chen | 15/105 |
| 2008/0276398 | A1 | 11/2008 | Nanda | |
| 2009/0070947 | A1 | 3/2009 | Baertschi et al. | |
| 2009/0144920 | A1 | 6/2009 | Nanda | |
| 2010/0106336 | A1 | 4/2010 | Hwang et al. | |
| 2011/0232012 | A1 | 9/2011 | Nanda | |
| 2011/0232015 | A1 | 9/2011 | Nanda | |

FOREIGN PATENT DOCUMENTS

| | | | |
|---|---|---|---|
| DE | 19811676 | * | 9/1999 |
| FR | 2680086 | * | 2/1993 |
| FR | 2724297 | | 3/1996 |
| FR | 2756471 | * | 6/1998 |
| JP | 64-8914 | * | 1/1989 |
| JP | 2004-222839 A | | 8/2004 |
| JP | 2006-42966 A | | 2/2006 |
| KR | 10-2004-0052897 A | | 6/1994 |
| KR | 10-0476657 B1 | | 3/2005 |
| WO | WO 00/20185 | | 4/2000 |

OTHER PUBLICATIONS

Written Opinion and Search Report of the International Searching Authority from PCT/US2008/082886 mailed Jan. 23, 2009.

International Search Report and Written Opinion for International Application No. PCT/US2011/038760, Notification mailed Feb. 24, 2012.

* cited by examiner

Section A–A

TOOTHBRUSH AND METHOD OF USE

CROSS-REFERENCE TO RELATED APPLICATIONS

This application claims the benefit under 35 U.S.C. §119 (e) of U.S. Provisional Patent Application No. 60/986,558, filed Nov. 8, 2007. The above-mentioned provisional patent application is hereby incorporated by reference in its entirety and made a part of this specification.

BACKGROUND OF THE INVENTION

1. Field of the Invention

The present inventions relate to dental hygiene and, more particularly, to toothbrushes.

2. Description of the Related Art

To ensure proper oral care, dentists recommend that we brush our teeth more than once a day for at least two to three minutes each time. Despite this recommendation, the average adult person does not brush his or her teeth for two to three minutes. This problem is worse with children, who have notoriously short attention spans and often view brushing their teeth as a chore. Accordingly, there is a general need for a device that encourages people, especially children, to brush their teeth more often and for longer periods of time. See e.g., U.S. Patent Publication No. 2004-0143920, filed Jan. 24, 2003 and published on Jul. 29, 2004, the entirety of which is hereby incorporated by reference herein.

SUMMARY OF THE INVENTION

U.S. Patent Publication No. 2004-0143920 describes a toothbrush with a handle having a base, a body, and a head. These toothbrushes help the user to brush for a sufficient period of time by flashing or remaining otherwise illuminated for an established time. The user is encouraged to brush and remain brushing while the toothbrush is lighted. This is especially useful for children for the reasons explained above.

One aspect of the present invention is that there may exist drawbacks and shortcomings to using light to help the user know how long to brush his or her teeth. For example, it may be difficult for the user to see the light when the toothbrush is in the mouth. It may be difficult to see when the light turns off in a well lit bathroom. There also exist many people who have difficulty seeing but who also could use some encouragement to brush more often and for longer periods of time. Applicant has recognized that a need exists for a musical toothbrush or one that projects sound instead of or together with light to inform the user how long they should brush.

Accordingly, one aspect of the present invention is a toothbrush comprising a handle having a first end and a second end and a head coupled to the first end of the handle, the head comprising a plurality of bristles. A handle cover is coupled to the second end of the handle. A loudspeaker is positioned in the handle. The tooth brush also includes a power source, a printed circuit board (PCB), and a microchip. The microchip is attached to the PCB. A switch is positioned in the handle such that when the switch is pressed the switch contacts the PCB but does not contact the PCB when it is not pressed. A control circuit configured such that contact between the switch the PCB completes a circuit and initiates the sound or music projection from the loudspeaker for a set period of time.

Another aspect of the present invention is a toothbrush as disclosed including a waterproof wall positioned in the handle and surrounding part of the switch to ensure that water does not enter the handle from the area around the switch.

Another aspect of the present invention is a toothbrush comprising a handle having a first end and a second end and a head coupled to the first end of the handle, the head comprising a plurality of bristles. A loudspeaker is positioned in the handle. A light source is positioned in the handle. The tooth brush also includes a power source, a PCB, and a microchip. The microchip is attached to the PCB. A switch is positioned in the handle such that when the switch is pressed the switch contacts the PCB but does not contact the PCB when it is not pressed. A control circuit configured such that contact between the switch the PCB completes a circuit and initiates illumination and sound or music projection from the loudspeaker for a set period of time.

Yet another aspect of the present invention is a toothbrush as in any of the previously disclosed aspects wherein the toothbrush further comprises a microchip. The microchip can be separate from the loudspeaker and easily removable so that one toothbrush can utilize different microchips. Each microchip could, for example, be programmed with different sounds or music. Thus, the control circuit would complete the circuit and initiate the microchip which would determine the sound or music to be projected from the loudspeaker.

The foregoing objects may also be achieved by a toothbrush having a handle having a base, a body, and a head. The body having a chamber therein. A loudspeaker for projecting sound or music located within the chamber. The toothbrush having at least one bristle attached to the head. The toothbrush having a handle cover attached to the base.

The foregoing objects may still further be achieved by a method of using a toothbrush. The method uses a toothbrush having a handle and a sound projection circuit. The toothbrush handle having a base, a body, and a head. The toothbrush sound projection circuit having a loudspeaker to project sound or music connected to a switch. The toothbrush sound projection circuit may further have a microchip programmed with sound or music connected to a loudspeaker. The method including the step of pressing the switch for completing the sound projection circuit. The method further including the step of activating a loudspeaker within the toothbrush to project sound or music. The method still further including the step of utilizing the toothbrush while the loudspeaker is activated.

DETAILED DESCRIPTION OF THE PREFERRED EMBODIMENTS

Figure 1:
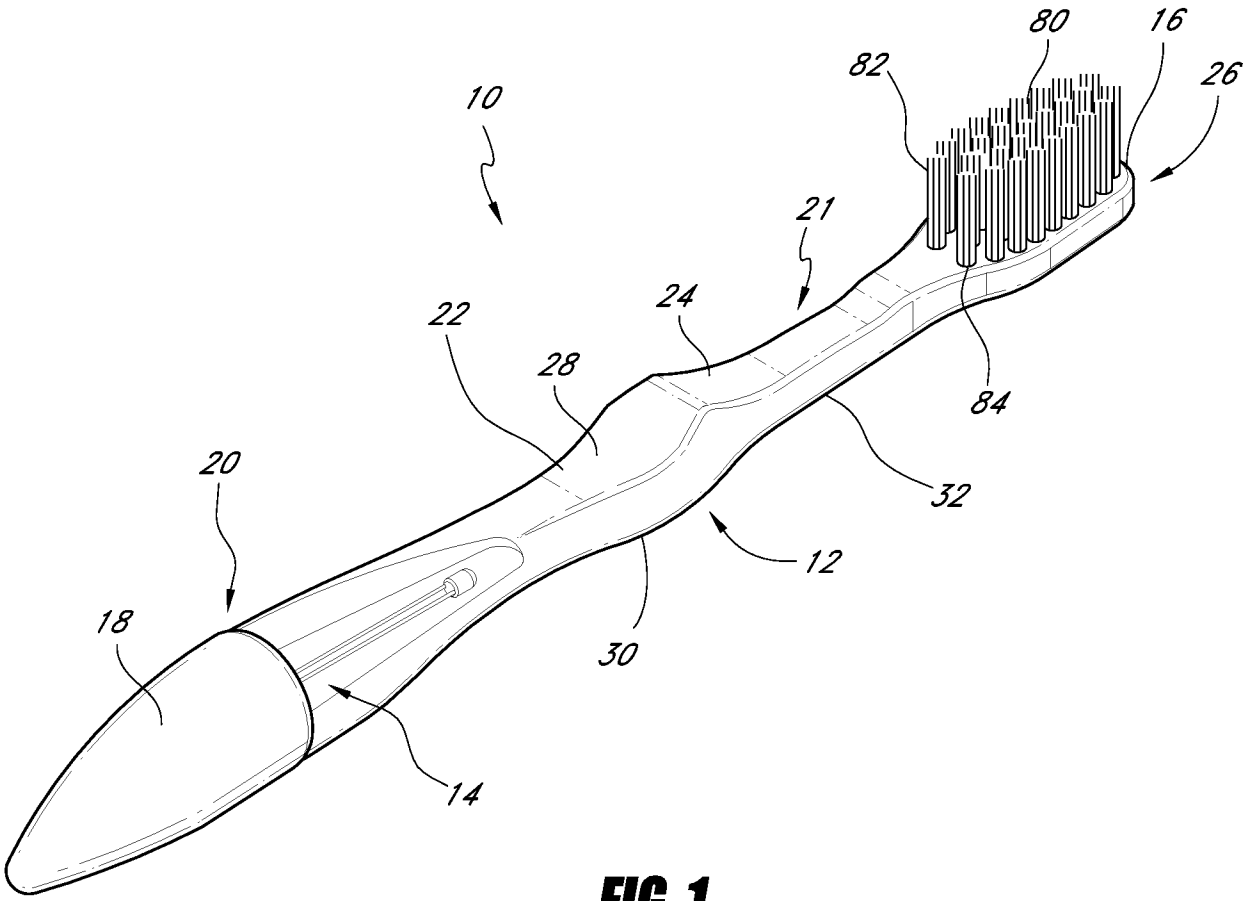
FIG. 1 (PRIOR ART)
FIG. 1 is a perspective view of a prior art toothbrush.

FIG. 1 illustrates a prior art illuminated toothbrush 10, which comprises a handle 12, an illumination circuit 14, a brush 16, and a grip 18.

As shown in FIG. 1, the handle 12 comprises a base 20, a body 21, and a head 26. The body 21 has a first section 22 and a second section 24. The handle 12 can be formed of hard, clear plastic. In one arrangement, the handle 12 can be a colored plastic. In another arrangement, the handle 12 can be a translucent plastic.

The toothbrush handle 12 can be formed through an injection molding process. In such an embodiment, plastic in a liquid form can be injected into a mold having two sections. Liquid plastic can be injected into the mold where it is then allowed to solidify. When the mold is opened it creates a handle having a brush side 28 and a non-brush side 30. At the intersection of these two sides 28, 30 can be a ridge 32. The ridge 32 can be a surface characteristic resulting from the injection molding process. In the illustrated arrangement, the ridge 32 does not extend inside the handle 12 but exists on the surface. The injection molding process in constructing of the toothbrush handle 12 is conventional and does not form a part of the present invention.

The brush 16 can have a bristle 80. The bristle 80 can have a first end 82 and a second end 84. The bristle second end 84 can be embedded in the head 26 of the handle 20.

Figure 2:
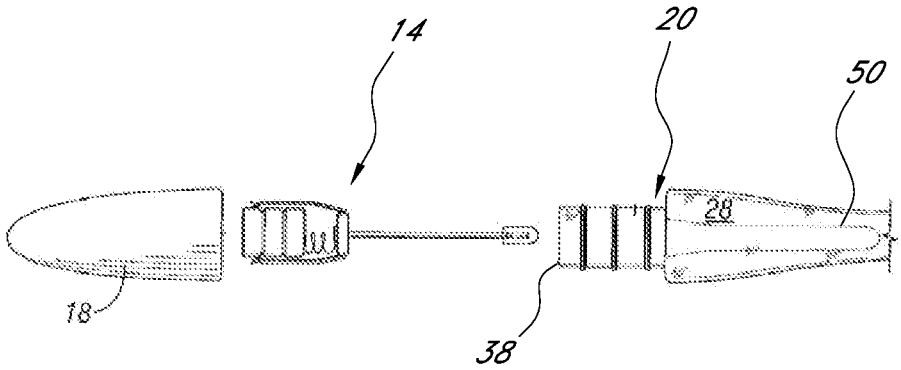
FIG. 2 (PRIOR ART)
FIG. 2 is an exploded top view of the toothbrush grip, base, and lower section of toothbrush handle showing the placement of the illumination circuit within the toothbrush handle.

The handle base 20 has an opening 38 and a cavity 50, see FIG. 2. The illumination circuit 14 fits partially inside the cavity 50 and partially within grip 18 which is essentially hollow. The chamber 50 can extend within the section 22. The chamber 50 can be generally cylindrical in shape.

Continuing to look at FIGS. 1 and 2, the first section chamber 50 can be also positioned in off-center alignment with the base 20 because in the first section 22 is ergonomically designed to accommodate a user's grip. In the ergonomic design, the brush side 28 of the first section 22 is contoured and the non brush side 30 of the first section 22 is flat. In addition, the brush side 28 of the first section 22 arrives at a point of the second section 24 at a greater angle than the non brush side 30. In other words, the illumination circuit 14 extends within the first section 22 substantially parallel to the center line of the base member 20 but the first section 22 brush side 28 angles toward the inner point where the first section 22 meets the second section 24 and the non brush side 30 portion of the first section 22 also angles toward the point where the first section 22 meets the second section 24. Thus, for the first section chamber 50 to extend the furthest into the first section 22 of the handle 12, the first section chamber 50 is preferably positioned closer to the non-brush side 30 of the first section 22.

FIGS. 3-14 illustrate embodiments of a toothbrush with a sound projection circuit that advantageously addresses the aforementioned problem. Numerical reference to components is the same as in the previously described arrangement, except that a prime symbol (') has been added to the reference. Where such references occur, it is to be understood that the components are the same or substantially similar to previously-described components.

Figures 3, 4, 5:
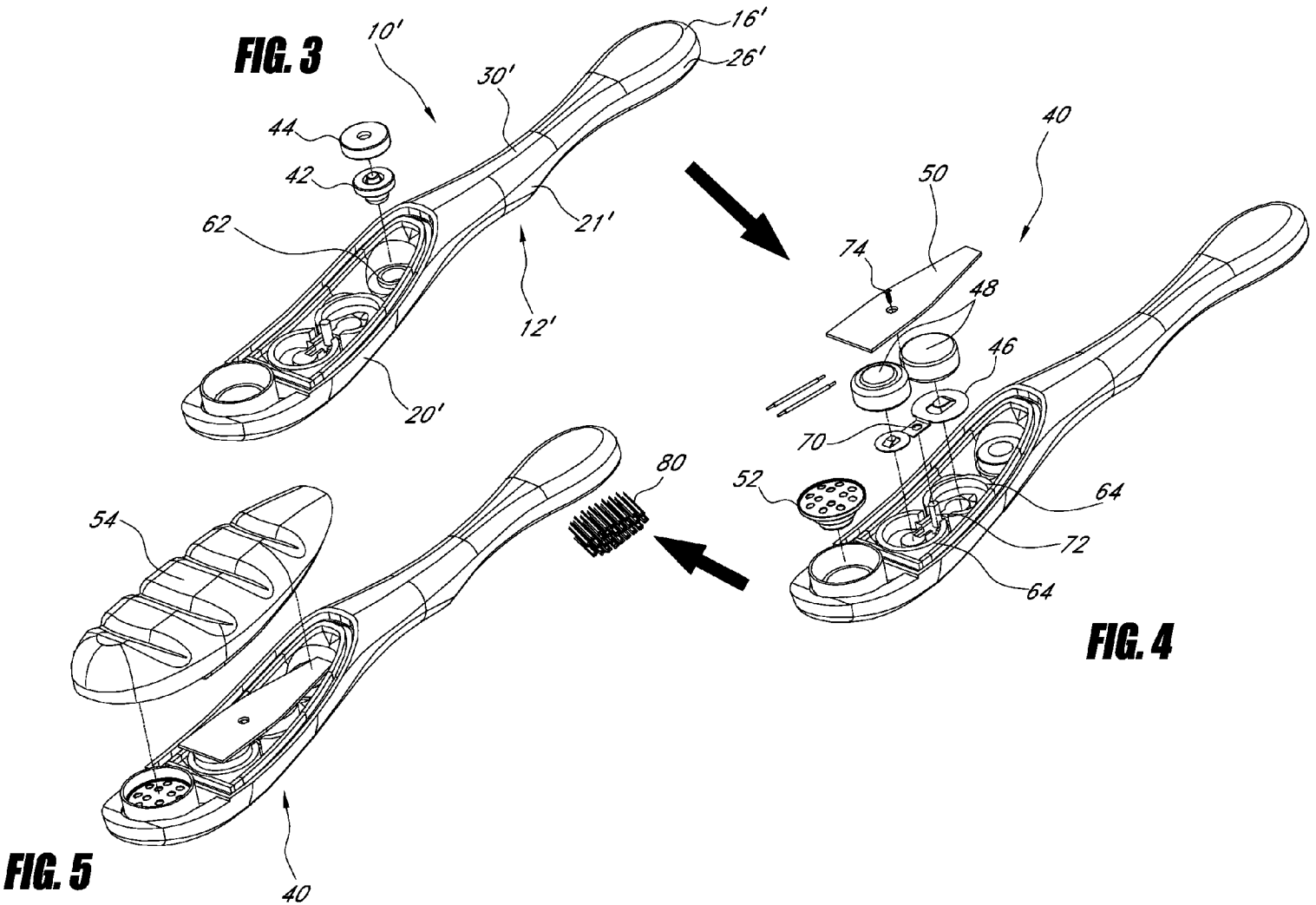
FIG. 3 is an exploded perspective view of a toothbrush handle, switch and waterproof wall.
FIG. 4 is an exploded perspective view of a toothbrush handle and the sound projection circuit.
FIG. 5 is an exploded perspective view of a toothbrush handle with the sound projection circuit installed, the handle cover and bristles.
Figure 6:
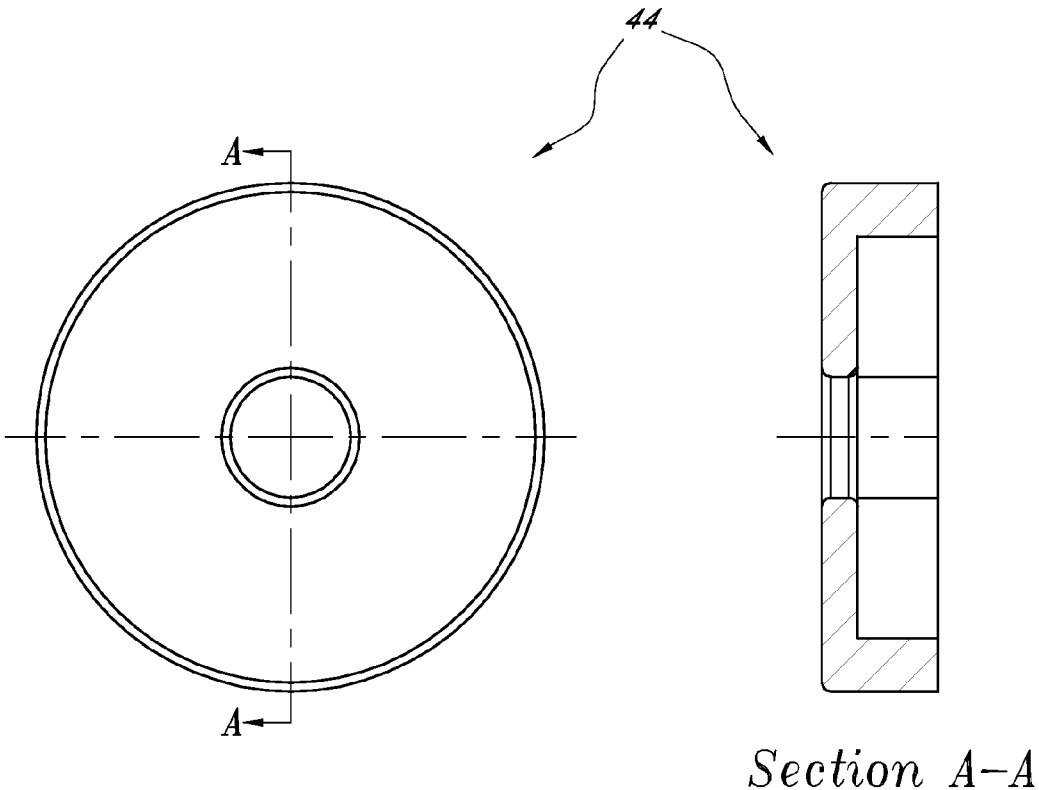
FIG. 6 shows front and side views of a waterproof wall.
Figure 7:
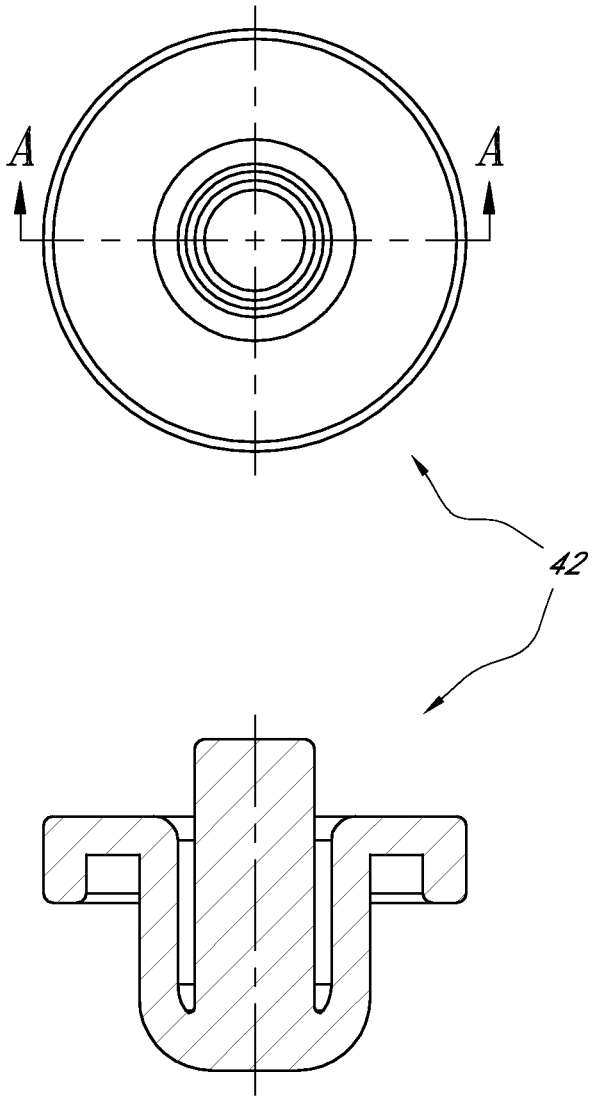
FIG. 7 shows a front view and a cross-sectional view of a switch.

FIG. 3 shows a toothbrush 10' with the non-brush side 30' on the top. The handle 12' has a base 20' which has been formed on the non-brush side 30' to receive the parts of the sound projection circuit 40 and activation means for activating the circuit 40. A waterproof wall 44 is used to cover a switch 42 which is placed in the switch holder 62. FIGS. 6-7 show the waterproof wall 44 and switch 42 respectively in more detail.

FIG. 4 shows a configuration of a sound projection circuit. A contact member 46 with a hole 70 is placed on post 72. The batteries 48 fit in the battery holders 64. The batteries 48, switch 42, waterproof wall 44 and contact member 46 are held in place by a printed circuit board (PCB) 50 and a screw 74. The screw 74 is screwed into the post 72. A microchip, not shown, is attached to the PCB. A loudspeaker 52 is also placed into the handle 12'.

Figure 8:
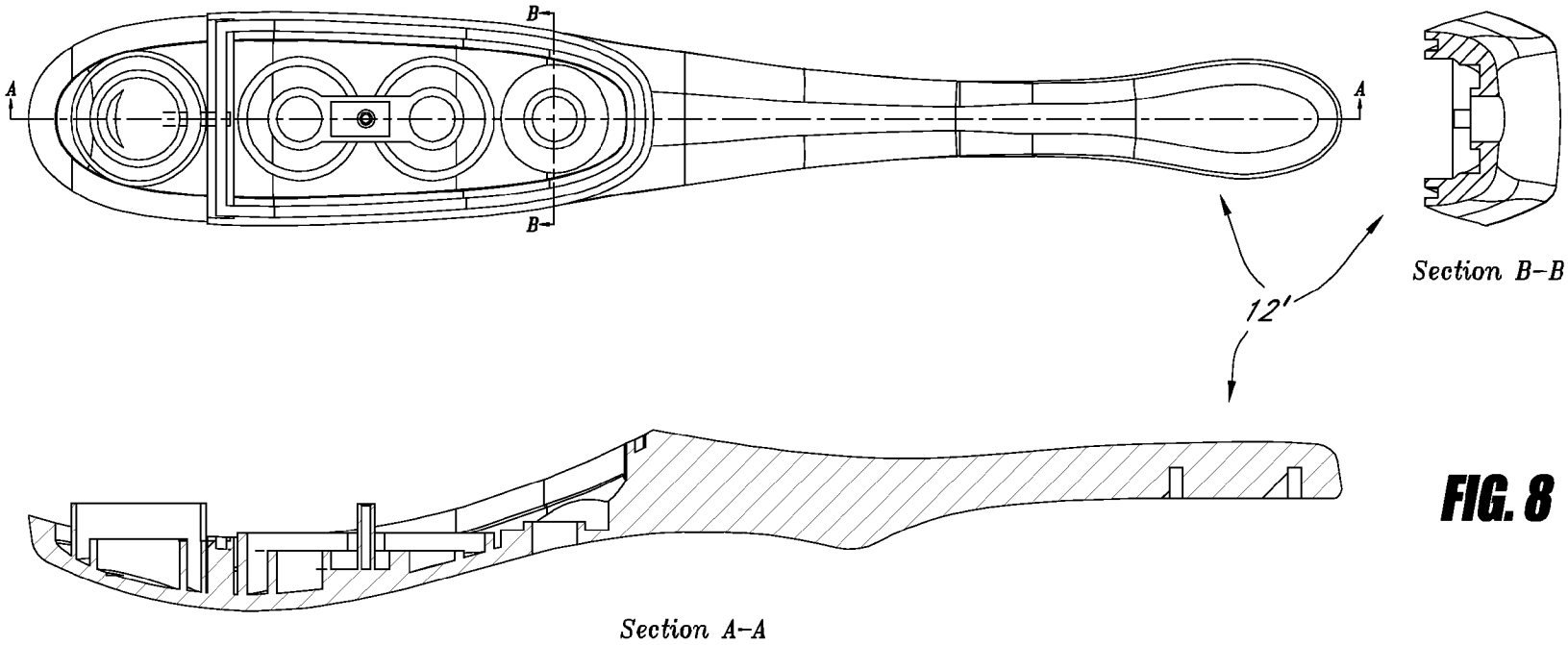
FIG. 8 shows top, side and front views of a toothbrush handle.
Figure 9:
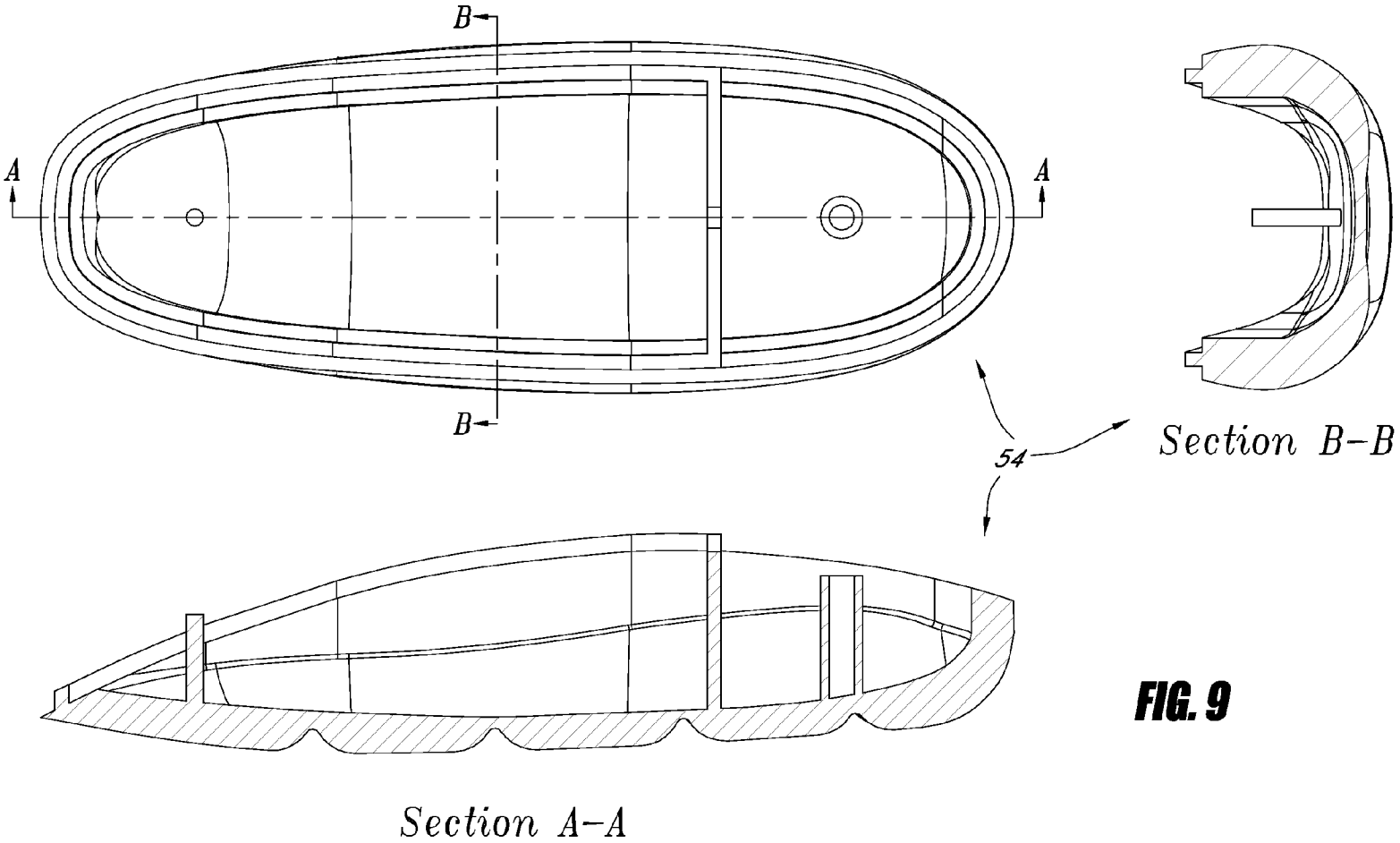
FIG. 9 shows top, side and front views of a toothbrush handle cover.

FIG. 5 shows the sound projection circuit 40 installed into the handle, the handle cover 54 and bristle 80'. FIG. 8 shows a more detailed view of the toothbrush handle 12'. FIG. 9 shows a more detailed view of the toothbrush handle cover 54.

Figure 10:
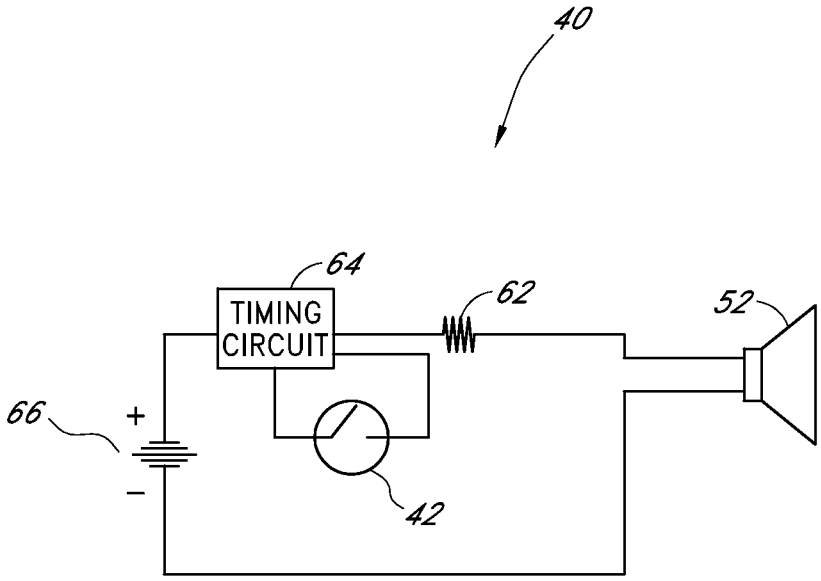
FIG. 10 is an embodiment of a sound projection circuit.

The sound project circuit 40, as shown in FIG. 10, can have a loudspeaker 52, a resistor 62, a timing circuit 64, and a power source 66. The timing circuit 64 can include the microchip. The microchip is programmed with a unique sound or music. The unique sound or music is projected by the loudspeaker 52 after the switch 42 is pressed, completing the sound projection circuit 40. The PCB 50 and microchip are preferably positioned on the outside of the handle 12' preferably immediately below the handle cover 54 such that it can be easily installed by attaching the screw 74 described above. In this manner, during mass production, toothbrushes 10' can be made with different microchips having different musical compositions or sound patterns. That is, a large number toothbrushes can be created with each toothbrush can have substantially the same or identical parts. To make toothbrushes with different musical or sound patterns, a different PCB board or microchip with a different musical program or sound pattern is added to the toothbrush. In this matter, product lines of toothbrushes with multiple musical or sound patterns can be cost effectively created.

The timing circuit 64 preferably can function to activate the loudspeaker 52 for approximately 60 seconds. The timing circuit 64 also preferably can serve to control the loudspeaker 60 to project a sound intermittently for the time period in which it is engaged. In some embodiments, the loudspeaker 52 may stay on continuously and/or sound for a longer or shorter period of time. In the illustrated embodiment, the circuit is activated by closing an electrical switch 42 to complete a circuit.

The switch 42 can be made of a flexible material. Alternatively, the switch 42 may be of a hard material but have a flexible portion that may be used to engage the PCB 50 to connect the sound projection circuit 40.

In operation, the musical toothbrush 10' is used by a user to indicate the duration of an amount of time. The user grips the toothbrush handle 12' in their hand with the bristle 80' surface with the bristle 80' against their teeth and engages the switch 42. The loudspeaker 52 begins to project sound intermittently in an on/off fashion. The loudspeaker 52 continues to sound for a period of approximately 60 seconds. The handle is designed to direct sound to the user in multiple ways so that the user may be accurately apprised of brushing time. The frequency of sound can remain constant, or vary in frequency. In some embodiments, the frequency can increase as the time approaches 60 seconds. In some embodiments, the frequency can remain constant through a first period of time, and increase in frequency in a second period of time. In one example, the frequency can remain constant for approximately 45 seconds; then increase for the remaining 15 seconds. In other embodiments, different time intervals can be used, such as, for example, two even periods of thirty seconds each.

Figure 11:
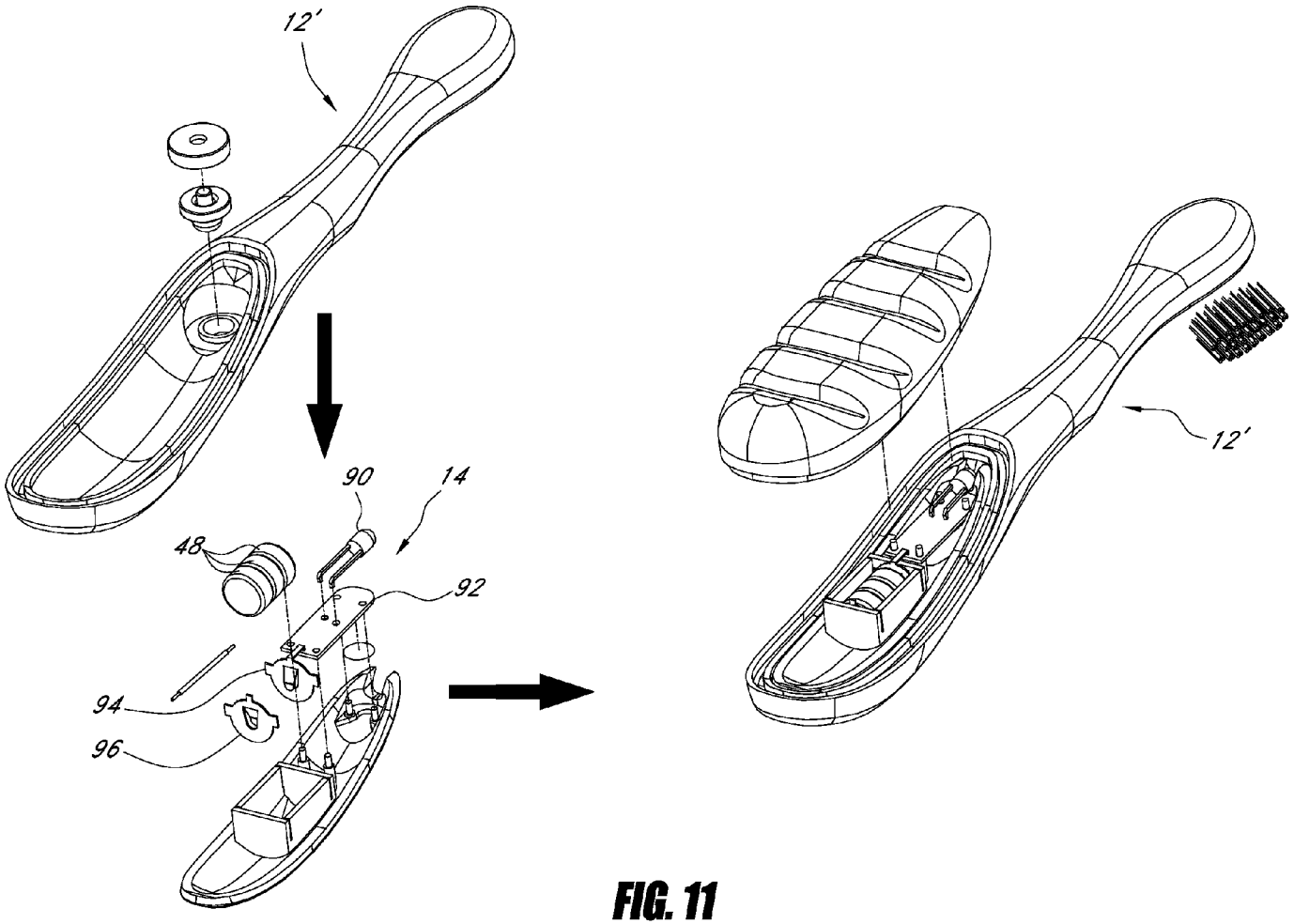
FIG. 11 is shows another aspect of the invention where the toothbrush is configured to include an illumination projection circuit.

As can be seen in FIG. 11, the toothbrush can be configured to have an illumination circuit 14 installed within the handle 12'. Though not shown the toothbrush can have a loudspeaker and microchip installed so that the toothbrush can play music or sound and illuminate. The illumination circuit 14 can include a light emitted diode (LED) 90, batteries 48, a first battery contact 94, a second battery contact 96 and a connector 92. The connector can be a simple electrical connector, a PCB or a timing circuit.

Figure 12:
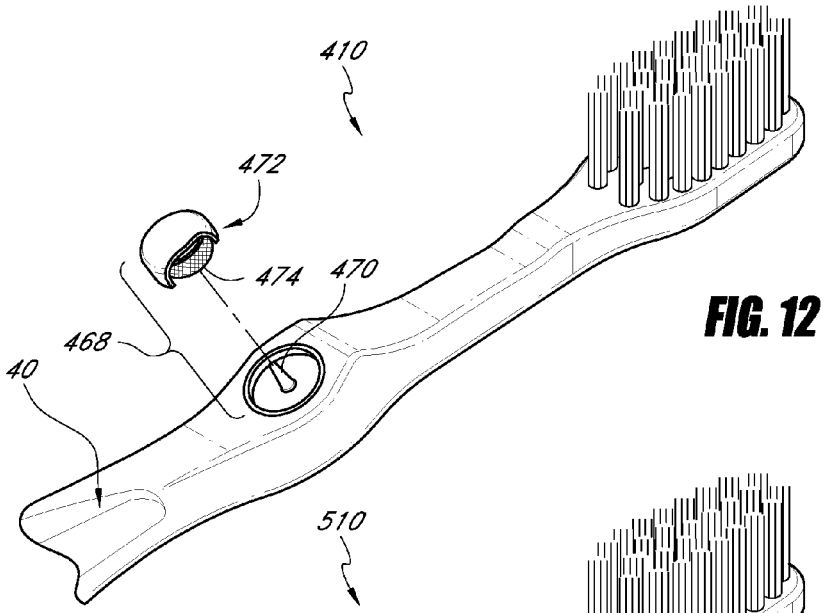
FIG. 12 is a perspective view of an embodiment of a toothbrush with a front-mounted button.
Figure 13:
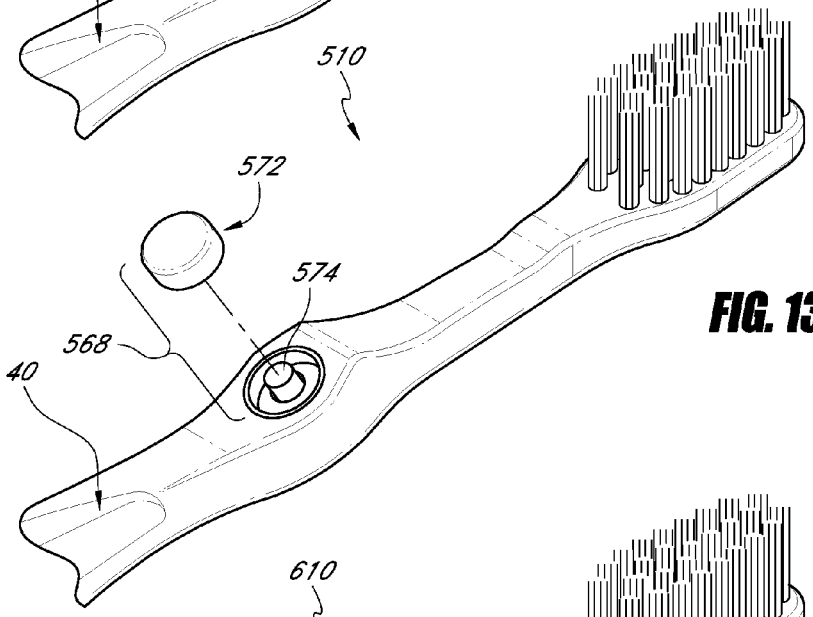
FIG. 13 is a perspective view of another embodiment of a toothbrush with a front-mounted button.
Figure 14:
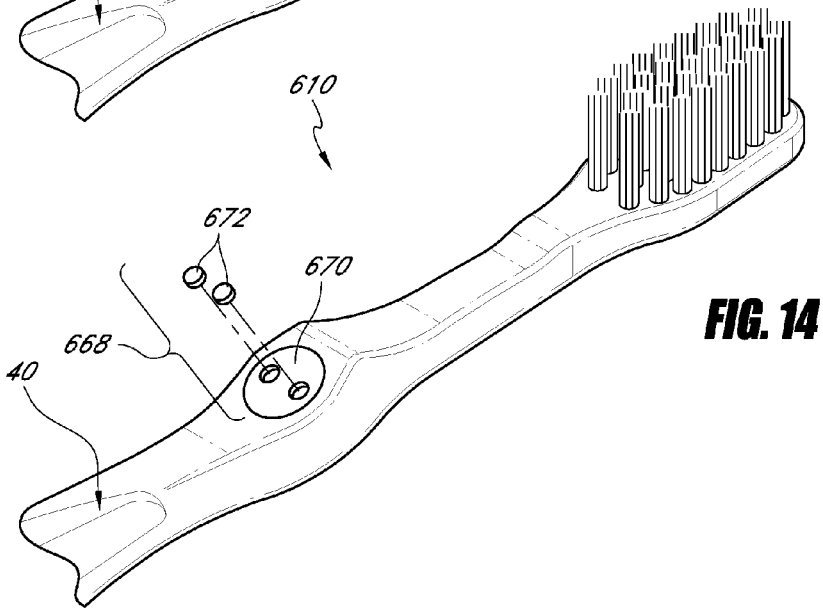
FIG. 14 is a perspective view of another embodiment of a toothbrush with a front-mounted button.

FIGS. 12-14 illustrate alternative embodiments of the toothbrush having a front-mounted activation mechanism for activating a sound projection circuit 40. The mechanism can comprise a variety of devices, some examples of which are illustrated and described below.

FIG. 12 illustrates an embodiment of a toothbrush 410 having an sound projection 40 and an activation mechanism 468. The mechanism 468 can comprise a contact port 470 and a button 472. The button 472 can comprise a metallic mesh 474 that surround the contact post 470, and activates the sound projection circuit 40, activating the loudspeaker, as described above. The mesh 474 can case the sound projection circuit 40 to activate through contact with a electrically-conducting inner surface, or support an electrically-conducting surface which activates the circuit 40. The mesh 474 can be replaced by a spring, flexible rods, or any other suitable device, as described above.

FIG. 13 illustrates another embodiment of a toothbrush 510 having a front-mounted activation mechanism. The mechanism can comprise a push-button device 568 having a button 572 and a switch device 574, as are well-known in the art. The push-button device 568 can cause the sound projection circuit 40 to activate the loudspeaker. The switch device 574 can be activated by manipulation of the button 572, whether the button 572 is flexible or a rigid connection to the switch device 574. The push-button device 568 can activate the circuit 40 once manipulated and future manipulations can be ignored by the circuit 40 until the timer has completed a cycle. This operation can occur in any embodiment described herein.

FIG. 14 illustrates another embodiment of a toothbrush 610, wherein a loudspeaker projects sound or music by a sound projection circuit 40. The circuit 40 can start a timed cycle upon receiving a signal from an activation device 668. In the illustrated embodiment, the activation device 668 comprises a base 670 and two contact terminals 672. The contact terminals 672 can activate the circuit 40 when electrical conduction occurs between the terminals 672. In one embodiment, the circuit 40 and terminals 672 can be constructed to allow contact with human skin to both terminals 672 to cause conduction to occur, thereby activating the circuit 40. In non-limiting examples, the palm of a human hand gripping the toothbrush can activate the circuit or, a finger or thumb pressed to touch both terminals 672 can activate the circuit 40. Water disposed in continuous contact with both terminals 672 can also activate the circuit 40.

Although certain embodiments, features, and examples have been described herein, it will be understood by those skilled in the art that many aspects of the methods and devices shown and described in the present disclosure may be differently combined and/or modified to form still further embodiments. For example, any one component of the toothbrushes shown and described above can be used alone or with other components without departing from the spirit of the present invention. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, it is intended that the scope of the present invention should not be limited by the particular embodiments described above, but should be determined only by a fair reading of the claims that follow.

What is claimed is:

1. A toothbrush comprising:

a handle having a first end and a second end;

a head coupled to the first end of the handle, the head comprising a plurality of bristles;

a handle cover coupled to the second end of the handle;

a loudspeaker or an illumination element positioned in the handle;

a power source positioned in the handle;

a printed circuit board (PCB) positioned in the handle;

a switch that contacts the PCB when the switch is pressed but does not contact the PCB when the switch is not pressed a control circuit configured such that contact between the switch and the PCB completes a circuit and initiates activation of the loudspeaker or the illumination element for a set period of time;

the handle further defining a housing comprising:

a switch holder contoured to receive and hold the switch within the handle; and a power source holder contoured to receive and hold the power source within the handle, wherein the PCB is positioned in the handle between 1) the handle cover and 2) the power source and the switch, the power source and the switch being held in place in the handle by the PCB, and further the power source is between the power source holder and the PCB and the switch is between the switch holder and the PCB.

2. The toothbrush of claim 1, wherein the set period of time is about 60 seconds.

3. The toothbrush of claim 1, wherein the power source comprises two batteries, each of the two batteries received into the power source holder.

4. The toothbrush of claim 3, wherein each of the batteries is separately received into the power source holder in opposite orientations.

5. The toothbrush of claim 4, further comprising a contact member positioned within the power source holder to electrically couple the two batteries.

6. The toothbrush of claim 1, further comprising a screw and wherein the handle further comprises a post for receiving the screw, the PCB attached to the housing through the screw.

7. The toothbrush of claim 1, further comprising a waterproof wall positioned around the switch and between the switch and the PCB.

8. The toothbrush of claim 1, wherein the PCB is immediately adjacent the handle cover.

9. A toothbrush comprising:

a handle extending along a longitudinal axis;

a handle cover coupled to a base end of the handle;

a brush coupled to a brush end of the handle;

a loudspeaker or an illumination element;

a power source;

a printed circuit board (PCB);

a control circuit;

a switch;

a waterproof wall positioned around a portion of the switch; and the control circuit configured such that activating the switch completes the circuit and initiates activation of the loudspeaker or the illumination element for a set period of time;

the handle further defining a housing comprising:

a switch holder contoured to receive and hold the switch within the handle; and a power source holder contoured to receive and hold the power source within the handle, wherein the PCB is positioned in the handle between 1) the handle cover and 2) the power source and the switch, the power source and the switch being held in place in the handle by the PCB, and further the power source is between the power source holder and the PCB and the switch is between the switch holder and the PCB, and the waterproof wall positioned around the switch and between the switch and the PCB.

10. The toothbrush of claim 9, wherein the toothbrush further comprises the loudspeaker and the illumination element.

11. The toothbrush of claim 10, where the illumination element further comprises an LED.

12. The toothbrush of claim 9, wherein the set period of time is about 60 seconds.

13. The toothbrush of claim 9, wherein the power source comprises two batteries, each of the two batteries received into the power source holder.

14. The toothbrush of claim 9, further comprising a contact member positioned within the power source holder to electrically couple the two batteries, each of the batteries is separately received into the power source holder in opposite orientations.

15. The toothbrush of claim 9, wherein the PCB is immediately adjacent the handle cover.

16. A toothbrush comprising:

a handle;

a head coupled to a first end of the handle, the head comprising a plurality of bristles;

a handle cover;

a loudspeaker or an illumination element positioned in the handle;

a power source;

a printed circuit board (PCB);

an activation device disposed in the handle;

a waterproof wall positioned around and covering a portion of the activation device; and a control circuit configured such that contact between a first contact member and a second contact member through the activation device completes a circuit and initiates sound projection of the loudspeaker or the illumination of the illumination element for a set period of time;

the handle further defining a housing comprising:

a first holder contoured to receive and hold the activation device within the handle; and a second holder contoured to receive and hold the power source within the handle, wherein the PCB is positioned in the handle between 1) the handle cover and 2) the power source and the activation device, the power source and the activation device being held in place in the handle by the PCB, and further the power source is between the second holder and the PCB and the activation device is between the first holder and the PCB.

17. The toothbrush of claim 16, wherein the power source comprises two batteries, each of the two batteries received into the second holder.

18. The toothbrush of claim 17, further comprising a contact member positioned within the second holder to electrically couple the two batteries, each of the batteries is separately received into the second holder in opposite orientations.

19. The toothbrush of claim 16, wherein the PCB is immediately adjacent the handle cover.

20. The toothbrush of claim 16, wherein the waterproof wall is positioned between the activation device and the PCB.

* * * * *